US005139645A

United States Patent [19]

Maxwell et al.

[11] Patent Number: 5,139,645

[45] Date of Patent: Aug. 18, 1992

[54] PROCESS FOR PRODUCING GASOLINE COMPONENTS

[75] Inventors: Ian E. Maxwell; Gerrit J. D. Otter, both of Amsterdam; Gregory V. Tonks, The Hague, all of Netherlands

[73] Assignee: Shell Oil Company, Houston, Tex.

[21] Appl. No.: 699,281

[22] Filed: May 13, 1991

[30] Foreign Application Priority Data

Jun. 18, 1990 [GB] United Kingdom ..... 9013566

[51] Int. Cl.[5] ..... C10G 63/06; C10G 65/14; C10G 7/00

[52] U.S. Cl. ..... 208/92; 208/93; 208/78; 208/79; 208/63; 585/800; 585/736; 585/750

[58] Field of Search ..... 208/78, 79, 92, 63, 208/93; 585/736, 737, 735, 738

[56] References Cited

U.S. PATENT DOCUMENTS 3,761,392 5/1972 Pollock ..... 208/93
3,785,955 1/1974 Davis ..... 208/65
4,834,866 5/1989 Schmidt ..... 208/65

*Primary Examiner*—Theodore Morris
*Assistant Examiner*—P. L. Hailey
*Attorney, Agent, or Firm*—Kimbley L. Muller

[57] ABSTRACT

Process for producing gasoline components from a hydrocarbonaceous feed containing hydrocarbons comprising at least 4 carbon atoms, and hydrocarbons obtained thereby. The process comprises:

a. separating feed into a heavy fraction containing hydrocarbons comprising at least 7 carbon atoms and a light fraction containing hydrocarbons comprising at most 7 carbon atoms, b. isomerizing at least part of the light fraction at a temperature between 50° and 300° C., c. separating effluent of step b) into a stream containing branched hydrocarbons and a stream containing normal hydrocarbons, and d. isomerizing at least part of the stream containing normal hydrocarbons at a temperature which is higher than the temperature applied in step b).

12 Claims, 1 Drawing Sheet

PROCESS FOR PRODUCING GASOLINE COMPONENTS

FIELD OF THE INVENTION

The present invention relates to producing gasoline components from a hydrocarbonaceous feed containing hydrocarbons comprising at least 4 carbon atoms.

BACKGROUND OF THE INVENTION

In U.S. Pat. No. 3,761,392 a process is described for the production of gasoline components. In this process a hydrocarbonaceous feed is separated into a first fraction containing hydrocarbons comprising 5 carbon atoms and a second fraction containing hydrocarbons comprising at least 6 carbon atoms. The first fraction is subjected to catalytic isomerization. The second fraction is subjected to catalytic reforming. By reforming the second fraction containing 6 carbon atoms, a considerable amount of benzene is being formed. It is now foreseen that for environmental reasons the allowed benzene content of gasoline will have to be reduced. On the other hand, benzene has a relatively high octane number. Hence, it will become increasingly necessary to replace benzene by other less harming, high octane components. Such components are produced in accordance with the present process.

DESCRIPTION OF THE INVENTION

Therefore, the present invention relates to a process for producing gasoline components from a hydrocarbonaceous feed containing hydrocarbons comprising at least 4 carbon atoms, which process comprises the following steps:

a) separating the feed by fractional distillation into at least a heavy fraction containing hydrocarbons comprising at least 7 carbon atoms and a light fraction containing hydrocarbons comprising at most 7 carbon atoms, b) isomerizing at least part of the light fraction at a temperature between 50° and 300° C., c) separating effluent of step b) into a stream containing branched hydrocarbons and a stream containing normal hydrocarbons, and d) isomerizing at least part of the stream containing normal hydrocarbons at a temperature which is higher than the temperature applied in step b).

Suitably, the process further comprises step e), in which at least part of the heavy fraction is catalytically reformed.

In the isomerization process according to the present invention the heavy fraction which can be subjected to catalytic reforming has a low content of compounds which will be present as benzene in the effluent of the catalytic reforming step, such as (cyclo)hexanes and benzene itself, in comparison with a conventional isomerization process. However, the light fraction of the process according to the invention contains compounds comprising 7 carbon atoms, which hydrocarbons enhance coke make in conventional isomerization. In the process according to the present invention, the amount of these hydrocarbons is reduced by first subjecting the light fraction to an isomerization step which is carried out at a lower temperature than conventionally applied. In this isomerization step preferentially hydrocarbons comprising 7 carbon atoms are being isomerized. Subsequently, the product obtained is passed to a separation step in which a stream containing branched and cyclic hydrocarbons and a stream containing normal hydrocarbons are separated off. At least part of the stream containing normal hydrocarbons is sent to an isomerization step which is carried out at a temperature conventionally applied. In this way, the amount of hydrocarbons comprising 7 carbon atoms which are sent to a conventional isomerization step, is reduced and coke make can be prevented.

The hydrocarbonaceous feed which is sent to fractionation step a), contains hydrocarbons comprising at least 4 carbon atoms. Generally, the feed contains mainly hydrocarbons comprising at least 5 carbon atoms. Small amounts of lighter hydrocarbons can in some cases be present. For economic reasons it can be advantageous that the separation by fractional distillation is not carried out very strictly, which makes that some lighter or heavier compounds can be present in the heavy or light fraction.

Effluent of the second isomerization step d), can be sent to the first isomerization step, b). Preferably, at least part of the effluent of the second isomerization step is passed, together with effluent of the first isomerization step, to separation step c).

The catalytic reforming can suitably be carried at a temperature of between 400° and 600° C. and a pressure of between 1 and 50 bar. Suitably, the heavy fraction is catalytically reformed by contacting with a reforming catalyst containing platinum and optionally at least one other metal.

For product finishing, effluent from the catalytic reforming step can be distilled and separated into at least a stream containing hydrocarbons comprising at most 4 carbon atoms and a stream containing hydrocarbons comprising at least 4 carbon atoms.

A further enhancement of the octane number of the gasoline components finally obtained in the process according to the present invention, can be attained by sending at least part of the effluent of the catalytic reforming step to the separation step c), together with effluent of the first and second isomerization step. Preferably, at least part of the effluent of the catalytic reforming step is distilled and separated into a stream containing hydrocarbons comprising at most 4 carbon atoms, a reformate stream containing mainly hydrocarbons comprising 5 to 7 carbon atoms and a stream containing hydrocarbons comprising at least 7 carbon atoms, at least part of which reformate stream is passed to separation step c).

Optionally, effluent of the catalytic reforming step, preferably reformate containing mainly hydrocarbons comprising 5 to 7 carbon atoms, is sent to isomerization step b).

The first isomerization step is carried out at a temperature between 50° and 300° C. It has been found that at too high a temperature the relatively heavy hydrocarbons enhance coke make, and therefore catalyst deactivation. Preferably, the first isomerization step is carried out at a temperature between 100° and 240° C. and a pressure between 10 and 60 bar. More preferably, the process is carried out at a temperature between 180° and 240° C. and a pressure between 15 and 50 bar.

In the first isomerization step an isomerization catalyst is present. Suitably, this isomerization catalyst is catalytically active in isomerization of hydrocarbons comprising 7 carbon atoms. Further, in some cases it can be advantageous that a catalyst is present which is catalytically active both in isomerization of hydrocarbons comprising 6 or 7 carbon atoms and in hydrogenating aromatic compounds.

The catalyst present in the second isomerization step suitably is catalytically active in isomerization of hydrocarbons comprising 5 or 6 carbon atoms. The second isomerization step is suitably carried out at a temperature between 120° and 320° C. and a pressure between 10 and 60 bar.

The isomerization catalysts employed are suitably heterogeneous hydroisomerization catalysts having an acid activity and a hydrogenation activity and comprising one or more metals from Group VIII of the Periodic Table of the Elements on a carrier material. The carrier material has acidic properties and may suitably consist of silica-alumina, in particular zeolites (e.g. mordenite, faujasite or zeolite Y) in the hydrogen form or exchanged with rare earth ions, or of alumina rendered acidic by combination with halogen (e.g. chlorine). Preferably, the employed catalysts comprise at least one noble metal from Group VIII on mordenite as carrier material. Suitably, the catalyst present in the first or second isomerization step comprises platinum on mordenite. More preferably, H-mordenite is used which is prepared by treating mordenite one or more times with an aqueous solution of an ammonium compound (e.g. ammonium nitrate), followed by drying (e.g. at 100°-200° C.) and calcining (e.g. at 400°-700° C.) of the treated mordenite. The isomerization catalyst may in addition comprise a binder material, such as alumina, silica or silica-alumina.

In the separation step use can be made of a separatory molecular sieve capable of separating a hydrocarbon species via selective adsorption. Suitably the molecular sieve which is applied is selective with respect to the degree of branching of the hydrocarbons applied, i.e. unbranched hydrocarbons should be substantially adsorbed, whereas cyclic and branched hydrocarbons should not be retained in any substantial amount in the molecular sieve. The selectivity is dependent to a large extent on the pore diameters of the molecular sieve. Suitably a separatory molecular sieve is used having a pore size which is sufficient to permit entry of normal hydrocarbons containing 4–7 carbon atoms, but restrictive to prohibit entry of such mono-methyl branched, dimethyl branched and cyclic hydrocarbons. Suitable pore diameters are in the range from 0.3–0.8 nm, and preferably from 0.4–0.6 nm. Synthetic or natural zeolites can be used as molecular sieve; suitably zeolite 5A is used. The particles which comprise molecular sieve material may in addition comprise a binder material such as alumina, silica or silica-alumina, in order to improve the crushing strength of the particles; said particles may also be mixed with particles which do not contain molecular sieve material.

DETAILED DESCRIPTION OF THE INVENTION

Figure 1:
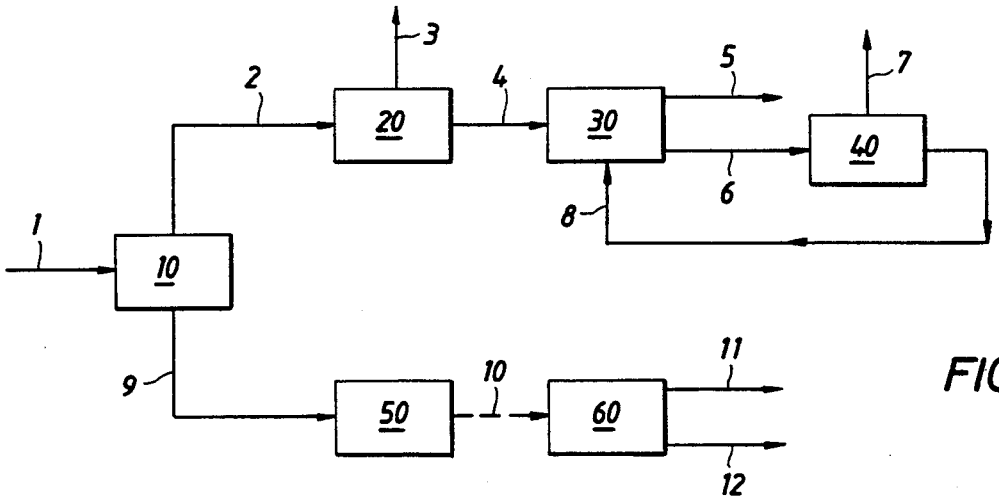
FIG. 1 is a flow scheme of the process of this invention.

The process according to the present invention can be carried out in a number of alternative ways, and some process schemes according to the invention will be elucidated more fully hereinafter, with reference to the accompanying figures. What process scheme is preferably used depends on the desired benzene concentration of the product and the desired octane number, and the concentration of benzene and benzene precursors in the feed.

The processes of the figures comprise a fractionation unit (10), a first isomerization unit (20), a separation unit (30), a second isomerization unit (40), a catalytic reforming unit (50) and optionally a distillation unit (60), wherein the effluent of the reforming unit is separated into several streams.

In the process schematically shown in FIG. 1 a feed (1) is passed to fractionation unit (10), in which the feed is separated into a heavy fraction (9), containing hydrocarbons comprising at least 7 carbon atoms, and a light fraction (2), containing hydrocarbons comprising at most 7 carbon atoms. The light fraction (2) is sent to the first isomerization unit (20). Hydrocarbons comprising at most 4 carbon atoms (3) are removed, and the remaining effluent of the first isomerization unit (4) is sent to separation unit (30), comprising a separatory molecular sieve with which normal hydrocarbons are separated from cyclic, mono- and multi-branched hydrocarbons, thereby producing a product stream (5) mainly comprising cyclic and mono- and multi-branched hydrocarbons, and a stream mainly comprising normal hydrocarbons (6). Stream (6) is passed to second isomerization unit (40) which is operated at a temperature which is higher than the temperature applied in the first isomerization unit. Hydrocarbons comprising at most 4 carbon atoms (7) are removed and the remaining effluent of the second isomerization unit (8) is passed to separation unit (30). The heavy fraction (9) is sent to catalytic reforming unit (50). The effluent obtained from reforming unit (50) can be sent to distillation unit (60), in which stream (10) is separated into a stream (11) containing hydrocarbons comprising at most 4 carbon atoms and a stream (12) containing mainly hydrocarbons comprising 5 carbon atoms or more.

Figure 2:
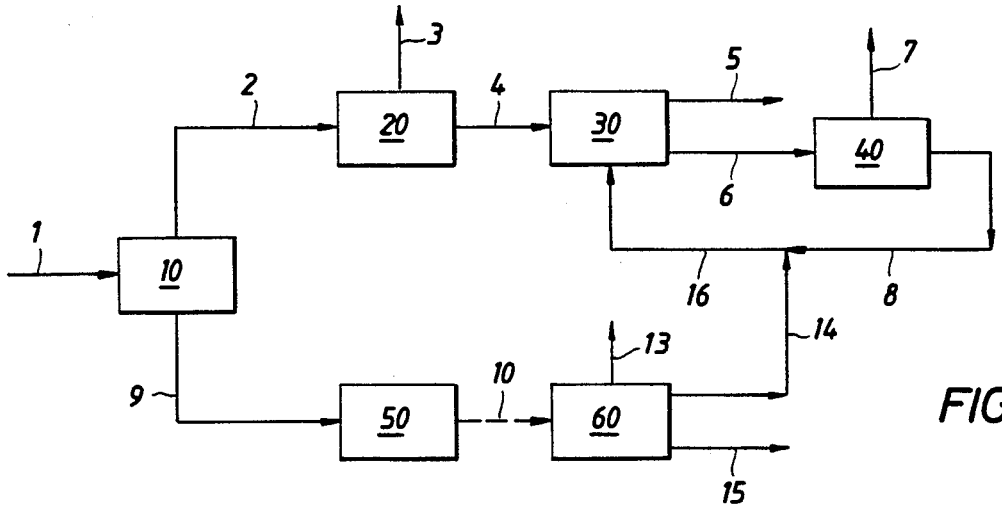
FIG. 2 is a flow scheme of the process of this invention in which the reformate is distilled and a portion thereof passed to the processing of the lighter fraction.

The process schematically shown in FIG. 2 resembles the process shown in FIG. 1. The process shown in FIG. 2 is a more preferred embodiment, in that the effluent of reforming unit (50) is sent to distillation unit (60), in which stream (10) is separated into a stream (13) containing hydrocarbons comprising at most 4 carbon atoms, a reformate stream (14) containing mainly hydrocarbons comprising 5 to 7 carbon atoms and a stream (15), containing hydrocarbons comprising at least 7 carbon atoms. The reformate stream (14) is sent to separation unit (30), together with effluent of the second isomerization unit (8).

Figure 3:
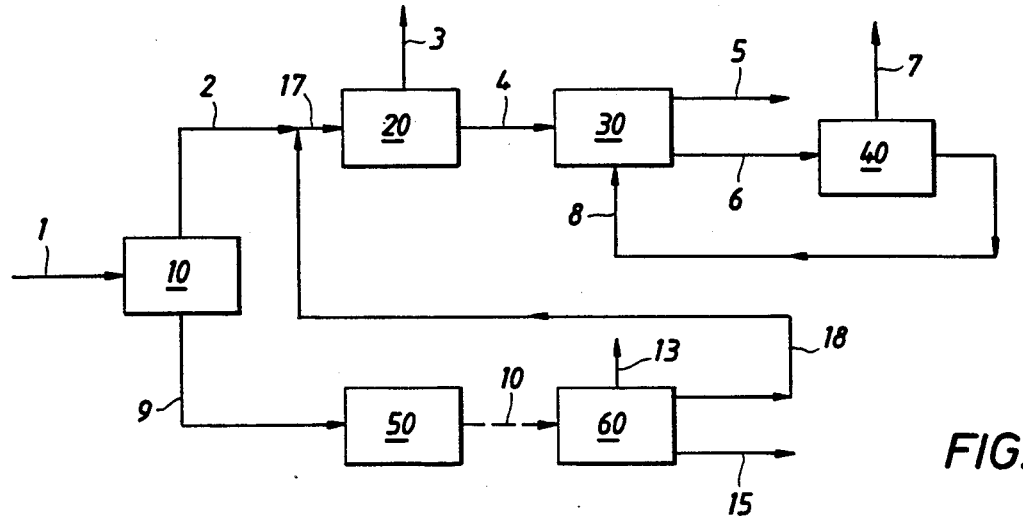
FIG. 3 is a flow scheme of the process of this invention in which the reformate is distilled and a portion thereof passed to the initial isomerization step isomerizing the lighter fraction.

The process schematically shown in FIG. 3 resembles the process shown in FIG. 1, and is optionally used instead of the process shown in FIG. 2. The process shown in FIG. 3 differs from the process shown in FIG. 2 in that reformate stream (18) is sent to the first isomerization unit (20), together with light fraction (2).

The invention will now further be elucidated with the aid of the following examples, in which hydrogen addition and removal have not been indicated. The hydrocarbon feed used had a RON of 58 and a benzene content of 1.1 % by weight.

EXAMPLE 1

This Example was performed according to the process scheme of FIG. 1.

A feed containing 100 pbw of hydrocarbons comprising at least 4 carbon atoms, which feed has a final boiling point of 200° C., was split by fractional distillation into a heavy fraction boiling above 93° C. and containing 52 pbw of hydrocarbons, of which hydrocarbons 91% by weight (% wt) comprised at least 7 carbon atoms and a light fraction boiling below 93° C. and containing 48 pbw of hydrocarbons, substantially all of which hydrocarbons comprised at most 7 carbon atoms. The light fraction was isomerized in a first isomerization step at a temperature of 220° C. and a pressure of 25 bar in the presence of a catalyst containing 0.3 pbw of platinum on mordenite (amount of metal on amount of mordenite). Hydrocarbons comprising at most 4 carbon atoms were removed from the effluent obtained and the remaining effluent was separated, together with stream (8) containing 14 pbw of hydrocarbons, with the help of zeolite 5A as separatory molecular sieve. A stream containing branched and cyclic hydrocarbons was separated off, which stream contained 45 pbw of hydrocarbons and 0.0% wt of benzene, and a stream containing normal hydrocarbons was separated off, which latter stream contained 14 pbw of hydrocarbons. The stream containing normal hydrocarbons was isomerized in a second isomerization step at a temperature of 260° C. and a pressure of 25 bar with the help of a catalyst containing 0.3 pbw of platinum on mordenite (amount of metal on amount of mordenite). Hydrocarbons comprising at most 4 carbon atoms were removed from the effluent obtained and the remaining effluent, hydrocarbon stream (8), was combined with the effluent of the first isomerization step.

The heavy fraction was reformed at a temperature of 500° C. and a pressure of 8 bar, with the help of a catalyst containing 0.3 pbw of platinum on alumina (amount of platinum on amount of alumina). The effluent obtained was distilled to give a stream containing hydrocarbons comprising at most 4 carbon atoms, which stream contained 3 pbw of hydrocarbons, and a stream containing hydrocarbons comprising at least 4 carbon atoms, which latter stream contained 47 pbw of hydrocarbons and 0.8% by weight of benzene.

In the above process in total 92 pbw of hydrocarbons comprising at least 5 carbon atoms was produced, which hydrocarbons had a benzene content of 0.4% wt and a RON of 90.

EXAMPLE 2

This Example was performed according to the process scheme of FIG. 2.

A feed containing 100 pbw of hydrocarbons comprising at least 4 carbon atoms, which feed had a final boiling point of 200° C. was split by fractional distillation into a heavy fraction boiling above 93° C. and containing 52 pbw of hydrocarbons, of which 91% wt comprised at least 7 carbon atoms and a light fraction, boiling below 93° C. and containing 48 pbw of hydrocarbons, substantially all of which hydrocarbons comprised at most 7 carbon atoms. The light fraction was isomerized in a first isomerization step at a temperature of 220° C. and a pressure of 25 bar in the presence of a catalyst containing 0.3 pbw of platinum on mordenite (amount of metal on amount of mordenite). Hydrocarbons comprising at most 4 carbon atoms were removed from the effluent obtained and the remaining effluent was separated, together with stream (16) containing 24 pbw of hydrocarbons, with the help of zeolite 5A as separatory molecular sieve. A stream containing branched and cyclic hydrocarbons was separated off, which stream contained 53 pbw of hydrocarbons and 0.7% wt of benzene, and a stream containing normal hydrocarbons was separated off, which latter stream contained 17 pbw of hydrocarbons. The stream containing normal hydrocarbons was isomerized in a second isomerization step at a temperature of 260° C. and a pressure of 25 bar with the help of a catalyst containing 0.3 pbw of platinum on mordenite (amount of metal on amount of mordenite). Hydrocarbons comprising at most 4 carbon atoms were removed from the effluent obtained. The remaining effluent, hydrocarbon stream (8), was combined with the effluent of the first isomerization step and with reformate stream (14).

The heavy fraction was reformed at a temperature of 500° C. and a pressure of 8 bar, with the help of a catalyst containing 0.3 pbw of platinum on alumina (amount of platinum on amount of alumina). The effluent obtained was distilled to give a stream containing hydrocarbons comprising at most 4 carbon atoms, which stream contained 3 pbw of hydrocarbons; a reformate stream containing hydrocarbons comprising 5 to 7 carbon atoms, which stream contained 9 pbw of hydrocarbons; and a stream containing hydrocarbons comprising at least 7 carbon atoms, which latter stream contained 38 pbw of hydrocarbons and 0.0% by weight of benzene. The reformate stream (14) was combined with the effluent of the first isomerization step and hydrocarbon stream (8).

In the above process in total 91 pbw of hydrocarbons comprising at least 5 carbon atoms was produced, which hydrocarbons had a benzene content of 0.4% wt and a RON of 91.

EXAMPLE 3

This Example was performed according to the process scheme of FIG. 3.

A feed containing 100 pbw of hydrocarbons comprising at least 4 carbon atoms, which feed had a final boiling point of 200° C. was split by fractional distillation into a heavy fraction boiling above 93° C. and containing 52 pbw of hydrocarbons, of which 91% wt comprised at least 7 carbon atoms and a light fraction, boiling below 93° C. and containing 48 pbw of hydrocarbons, substantially all of which hydrocarbons comprised at most 7 carbon atoms. The light fraction was isomerized together with reformate stream (18), comprising 9 pbw of hydrocarbons, in a first isomerization step at a temperature of 220° C. and a pressure of 25 bar in the presence of a catalyst containing 0.3 pbw of platinum on mordenite (amount of metal on amount of mordenite). Hydrocarbons comprising at most 4 carbon atoms were removed from the effluent obtained and the remaining effluent was separated, together with stream (8) containing 15 pbw of hydrocarbons, with the help of zeolite 5A as separatory molecular sieve. A stream containing branched and cyclic hydrocarbons was separated off, which stream contained 52 pbw of hydrocarbons and 0.0% wt of benzene, and a stream containing normal hydrocarbons was separated off, which latter stream contained 16 pbw of hydrocarbons. The stream containing normal hydrocarbons was isomerized in a second isomerization step at a temperature of 260° C. and a pressure of 25 bar with the help of a catalyst containing 0.3 pbw of platinum on mordenite (amount of metal on amount of mordenite). Hydrocarbons comprising at most 4 carbon atoms were removed from the effluent obtained. The remaining effluent, hydrocarbon stream (8), was combined with the effluent of the first isomerization step.

The heavy fraction was reformed at a temperature of 500° C. and a pressure of 8 bar, with the help of a catalyst containing 0.3 pbw of platinum on alumina (amount of platinum on amount of alumina). The effluent obtained was distilled to give a stream containing hydrocarbons comprising at most 4 carbon atoms, which stream contained 3 pbw of hydrocarbons; a reformate stream containing hydrocarbons comprising 5 to 7 carbon atoms, which stream contained 9 pbw of hydrocarbons; and a stream containing hydrocarbons comprising at least 7 carbon atoms, which latter stream contained 38 pbw of hydrocarbons and 0.0% by weight of benzene. The reformate stream (18) was combined with the light fraction (2).

In the above process in total 91 pbw of hydrocarbons comprising at least 5 carbon atoms was produced, which hydrocarbons had a benzene content of 0.0% wt and a RON of 91.

EXAMPLE 4 (COMPARATIVE)

A feed containing 100 pbw of hydrocarbons comprising at least 4 carbon atoms, which feed had a final boiling point of 200° C., was split by fractional distillation into a heavy fraction boiling above 70° C. and containing 72 pbw of hydrocarbons, substantially all of which hydrocarbons comprised at least 6 carbon atoms and a light fraction boiling below 70° C. and containing 28 pbw of hydrocarbons, substantially all of which hydrocarbons comprised at most 6 carbon atoms. The light fraction was isomerized in a first isomerization step at a temperature of 260° C. and a pressure of 25 bar in the presence of a catalyst containing 0.3 pbw of platinum on mordenite (amount of metal on amount of mordenite). Hydrocarbons comprising at most 4 carbon atoms were removed from the effluent obtained and the remaining effluent was separated with the help of zeolite 5A as separatory molecular sieve. A stream containing branched and cyclic hydrocarbons, which stream contained 26 pbw of hydrocarbons and 0.0% wt of benzene, and a stream containing normal hydrocarbons were separated off, which latter stream contained 9 pbw of hydrocarbons.

The heavy fraction was reformed at a temperature of 500° C. and a pressure of 8 bar, with the help of a catalyst containing 0.3 pbw of platinum on alumina (amount of platinum on amount of alumina). The effluent obtained was distilled to give a stream containing hydrocarbons comprising at most 4 carbon atoms, which stream contained 4 pbw of hydrocarbons, and a stream containing hydrocarbons comprising at least 4 carbon atoms, which latter stream contained 66 pbw of hydrocarbons and 9.7% by weight of benzene.

In the above process in total 92 pbw of hydrocarbons comprising at least 5 carbon atoms was produced, which hydrocarbons had a benzene content of 6.5% wt and a RON of 93.

What we claim as our invention is:

1. A process for producing gasoline components from a hydrocarbonaceous feed containing hydrocarbons having at least 4 carbon atoms, which process comprises:

a. passing said feed to a first separation zone and separating said feed by means of fractional distillation into at least: i) a heavy fraction containing hydrocarbons having at least 7 carbon atoms, and ii) a light fraction containing hydrocarbons having at most 7 carbon atoms;

b. passing said light fraction to a first isomerization zone to isomerize said light fraction, in the presence of a first isomerization catalyst, and at a temperature in the range of 50° to 300° C. and at a pressure of between 10 and 60 bar to form a first isomerization zone effluent stream;

c. passing said first isomerization zone effluent stream to a second separation zone to separate said first isomerization zone effluent stream into a normal separation fraction containing normal hydrocarbons and a branched separation fraction containing branched hydrocarbons; and d. passing said normal separation fraction to a second isomerization zone to isomerize, in the presence of a second isomerization catalyst, and at a temperature greater than the temperature of said first isomerization zone, and maintained at a pressure of from 10 to 60 bar to produce a second isomerization zone effluent stream containing normal hydrocarbons and branched hydrocarbons.

2. The process of claim 1 wherein said heavy fraction is passed to a reforming zone wherein said heavy fraction is reformed at a temperature of between 400° and 600° C. and a pressure of between 1 and 50 bar to produce a reformate effluent stream.

3. The process of claim 2 wherein said reformate effluent stream is passed to a third separation zone and separated by means of distillation into a third separation zone stream comprising hydrocarbons having 5 to 7 carbon atoms and a third separation zone stream comprising hydrocarbons having at least 7 carbon atoms.

4. The process of claim 3 wherein said third separation zone stream comprising hydrocarbons having 5 to 7 carbons atoms is passed to said second separation zone to separate said third separation zone stream comprising hydrocarbons having 5 to 7 carbon atoms into said normal separation fraction and said branched separation fraction.

5. The process of claim 3 wherein said third separation zone stream comprising hydrocarbons having 5 to 7 carbon atoms is passed to said first isomerization zone to form said first isomerization zone effluent stream.

6. The process of claim 1 wherein said second isomerization zone effluent stream is passed to said second separation zone to be separated into said normal separation fraction and said branched separation fraction.

7. The process of claim 1 wherein the temperature in said first isomerization zone is in the range of 100° to 240° C.

8. The process of claim 1 wherein said isomerization catalyst in said first and second isomerization zone comprises platinum dispersed on alumina.

9. The process of claim 1 wherein said isomerization catalyst in said first isomerization zone is catalytically active to isomerize hydrocarbons having 6 or 7 carbon atoms and in hydrogenating aromatic compounds.

10. The process of claim 1 wherein the temperature in said second isomerization zone is in the range of 120° to 320° C.

11. The process of claim 1 wherein said second separation zone comprises a molecular sieve sufficient to separate said normal hydrocarbons from said branched hydrocarbons based on the difference in the degree of branching of said normal and branched hydrocarbons to form said branched and normal hydrocarbon separation fractions.

12. The process of claim 11 wherein said branched separation fraction comprises mono-methyl branched hydrocarbons, diemethyl branched hydrocarbons and cyclic hydrocarbons.

* * * * *